US009165726B2

(12) United States Patent
Dohnal et al.

(10) Patent No.: US 9,165,726 B2
(45) Date of Patent: Oct. 20, 2015

(54) TAP CHANGER AND VACUUM SWITCHING TUBE FOR SUCH A TAP CHANGER

(75) Inventors: Dieter Dohnal, Lappersdorf (DE); Klaus Hoepfl, Maxhuette-Haidhof (DE); Christian Pircher, Lappersdorf (DE); Silke Wrede, Zeitlarn (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 129 days.

(21) Appl. No.: 13/811,757

(22) PCT Filed: Sep. 2, 2011

(86) PCT No.: PCT/EP2011/004433

§ 371 (c)(1),
(2), (4) Date: Feb. 18, 2013

(87) PCT Pub. No.: WO2012/034653

PCT Pub. Date: Mar. 22, 2012

(65) Prior Publication Data

US 2013/0220782 A1 Aug. 29, 2013

(30) Foreign Application Priority Data

Sep. 17, 2010 (DE) ..... 10 2010 045 901

(51) Int. Cl.
*H01H 9/00* (2006.01)
*H01H 33/16* (2006.01)
(Continued)

(52) U.S. Cl.
CPC ..... *H01H 9/0038* (2013.01); *H01F 29/04* (2013.01); *H01H 9/0027* (2013.01); *H01H 33/16* (2013.01); *H01H 33/6647* (2013.01)

(58) Field of Classification Search
CPC ..... H01F 29/04; H01H 9/0038; H01H 33/16; H01H 33/6647; H01H 2033/66276; H01H 2033/66292; H01H 9/0005
USPC ..... 218/48, 123, 136, 146, 154; 200/11 TC
See application file for complete search history.

(56) References Cited

U.S. PATENT DOCUMENTS 5,488,212 A 1/1996 Fukushi

FOREIGN PATENT DOCUMENTS

DE 2021575 A 12/1971
DE 3344376 A 6/1985

(Continued)

OTHER PUBLICATIONS

Machine translation of Burghauser et al DE102006033422 (Nov. 2007).*

(Continued)

*Primary Examiner* — Renee Luebke
*Assistant Examiner* — William Bolton
(74) *Attorney, Agent, or Firm* — Andrew Wilford

(57) ABSTRACT

A tap changer for uninterrupted switching over between winding taps of a tapped transformer has two load branches each for a respective phase to be switched. Each load branch has a vacuum switching contact acting as main contact and parallel thereto at least one series connection of a switch-over resistance and a respective further vacuum switching contact. The two load branches are connected with a common load shunt or connectable by mechanical switching elements. Two respective vacuum switching contacts of each load branch are constructionally combined to form a single vacuum switching tube with two separate movable contacts actuatable independently of one another and a common fixed contact. The common fixed contact is connected with the common load shunt or connectable mechanical switching contacts.

6 Claims, 4 Drawing Sheets

(51) Int. Cl.
*H01H 33/664* (2006.01)
*H01F 29/04* (2006.01)

(56) References Cited

FOREIGN PATENT DOCUMENTS

| | | | |
|---|---|---|---|
| DE | 19756308 | B | 3/1999 |
| DE | 102006033422 | A | 11/2007 |
| DE | 102009048813 | A | 4/2011 |
| EP | 0258614 | A | 3/1988 |
| JP | 2003297648 | * | 10/2003 |

OTHER PUBLICATIONS

Machine translation of JP2003297648 attached to Office Action.*

* cited by examiner

*Fig. 1 - Prior Art*
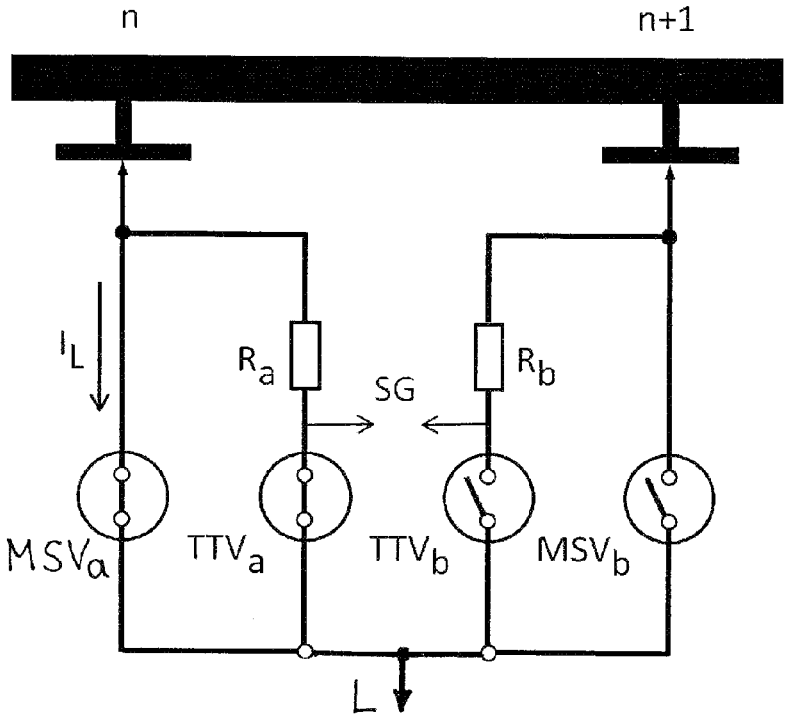
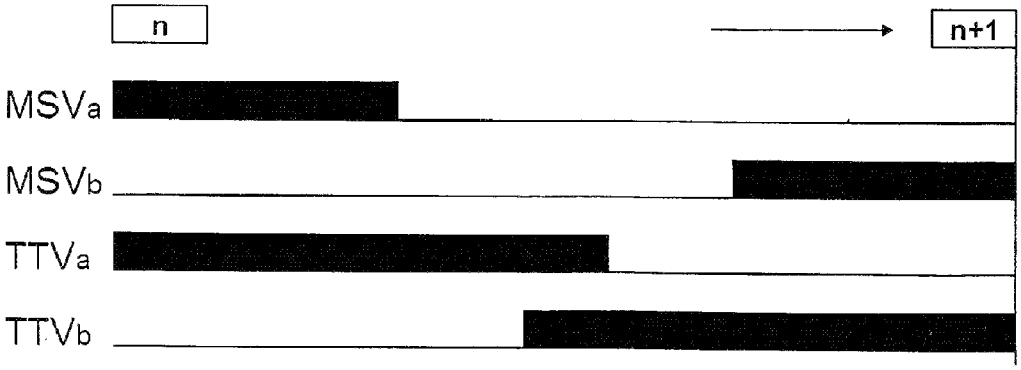
*Fig. 2*

TAP CHANGER AND VACUUM SWITCHING TUBE FOR SUCH A TAP CHANGER

CROSS REFERENCE TO RELATED APPLICATIONS

This application is the US-national stage of PCT application PCT/EP2011/004433 filed 2 Sep. 2011 and claiming the priority of German patent application 102010045901.1 itself filed 17 Sep. 2010.

FIELD OF THE INVENTION

The present invention relates to a tap changer with vacuum-tube switches for switching between winding taps of a tapped transformer. The invention further relates to a novel vacuum-tube switch for such a tap changer.

BACKGROUND OF THE INVENTION

A tap changer is known from DE 20 21 575 that has in total four vacuum switching tubes per phase. Provided in each of the two load branches are a respective vacuum switching tube as a main contact and a respective further vacuum switching tube, in series connection with a switch-over resistance, as resistance contact. In the case of uninterrupted load changeover from the previous winding tap n to a new, preselected winding tap n+1 initially the main contact of the side being switched off is opened and thereupon the resistance contact of the side taking over is closed so that an equalizing current limited by the switch-over resistances flows between the two taps n and n+1. After the previously closed resistance contact of the side switching off has opened, the main contact of the side taking over then closes so that the entire load current is conducted from the new winding tap n+1 to the load shunt; the changeover is concluded.

In DE 10 2009 048 813, which is not prior published, a further tap changer is described in which additionally further mechanical switches are provided between the electrical connection of the two vacuum switching tubes of each load branch and the load shunt.

The known tap changers require four separate vacuum switching tubes per phase. At the outset, the requirement for a large amount of space for these vacuum switching tubes is itself, as well as the associated actuating mechanism, disadvantageous. In addition such known constructions are relative expensive due to the high component outlay.

OBJECTS OF THE INVENTION

It is an object of the invention to provide a tap changer that with the same functionality is more simply constructed and in which the switching elements require less space and moreover are less expensive.

In addition, it is an object of the invention to indicate a vacuum switching tube that is usable particularly advantageously for a tap changer further developed in this way.

SUMMARY OF THE INVENTION

The tap changer according to the invention is based on the general idea of combining the two vacuum switching tubes in each load branch to form a single vacuum switching tube.

Moreover, the vacuum switching tube according to the invention is based on the general idea of combining the functionality of two constructionally identical tubes in a tap changer through the combination of a constructional form of a tube with two movable contact systems. In that case, the novel vacuum switching tube is of simple construction; in particular, it does not have any internally disposed contact compression springs or slide contacts.

Vacuum switching tubes with two contact places are already known per se. DE 3344367 relates to a vacuum switching tube with two contact pairs, which are electrically connected in series, in a single vacuum chamber, the contact pairs being actuatable simultaneously. DE 197 56 308 C1 relates to a similar vacuum switching tube with two switching paths arranged on a common axis, wherein internally disposed contact compression springs are provided. EP 0 258 614 B1 describes the combination of a vacuum switching tube and a specific electrical connection with a tap changer. In this regard, a plurality of switching paths is arranged in a vacuum chamber, which obliges a complicated construction of the vacuum switching tube with annular fixed contacts. Finally, DE 10 2006 033 422 B3 describes a further vacuum switching tube with a multiple functionality, wherein not only annular fixed contacts, but also internally disposed contact compression springs are also required here. None of these known solutions is suitable for a tap changer according to the invention.

According to a preferred embodiment of the vacuum switching tube according to the invention the geometric dimensions of the two separate contact systems are adapted to the electrical specifications of the circuit on which the tap changer is based, particularly whether the separate contact system is used as a main contact or auxiliary contact. For this purpose, for example, the diameter of the housing or also the stroke of the plunger of the respective separate contact system is selectively geometrically varied. In other words: The two separate contact systems of the common vacuum switching tube are not constructed identically, but are adapted by different geometric dimensioning to the electrical specifications of the tap changer. The general idea in accordance with the invention of the present vacuum switching tube is, as already explained, to combine the functionality of two constructionally identical tubes in a tap changer by the combination of a constructional form of a tube with two movable contact systems. As also described further above, in that case, however, the respective movable contact systems do not have to have the same electrical characteristics, since the contact systems fulfil different switching tasks within the switching sequence of the tap changer. In that case, a geometrically larger size of a contact system generally means greater dielectric spacings in the interior of the vacuum switching tube. This relationship is in that regard utilized by the present form of embodiment in particularly simple manner in that it matches the separate contact systems in their geometric form to the respective electrical boundary conditions of the circuit on which the tap changer is based.

BRIEF DESCRIPTION OF THE DRAWING

The invention shall be explained in more detail in the following by way of example on the basis of drawings, in which:

FIG. 1 shows a tap changer according to the prior art,

FIG. 2 shows a changeover sequence of such a known tap changer,

SPECIFIC DESCRIPTION OF THE INVENTION

A known tap changer is shown in FIG. 1. It comprises a first load branch in which a vacuum switching tube $MSV_a$ acting as a main contact as well as a switch-over resistance $R_a$ parallel thereto and a vacuum switching tube $TTV_a$ acting as a resistance contact are disposed. The second load branch has, in analogous manner, a vacuum switching tube $MSV_b$ as well as a further switch-over resistance $R_b$ parallel thereto and a vacuum switching tube TTVb. The known tap changer thus has two vacuum switching cells per load branch, thus in total four vacuum switching cells per phase.

FIG. 2 shows the switching sequence of such a known tap changer in the case of switching-over from the winding tap n to the winding tap n+1. The starting position, in which the tap n is electrically connected, corresponds with the setting that is illustrated in FIG. 1, of the individual switching elements. The changeover takes place in the following steps:

$MSV_a$ opens $TTV_b$ closes $TTV_a$ opens $MSV_b$ closes;

the changeover is concluded.

Figure 3:
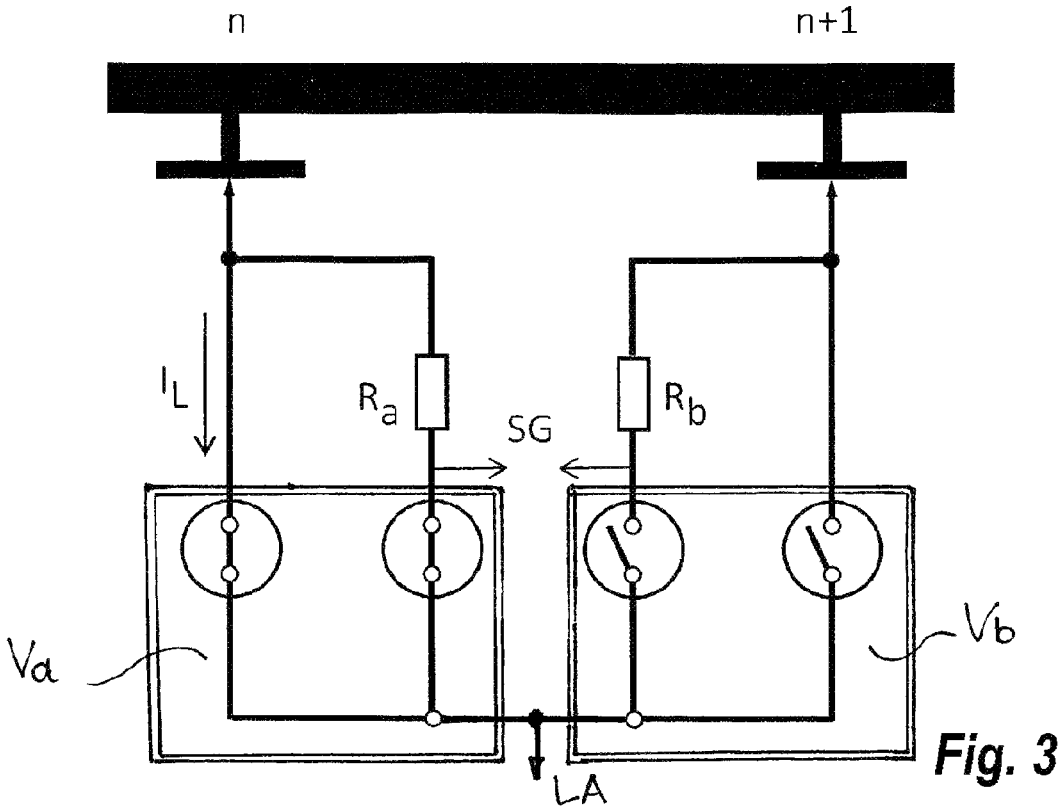
FIG. 3 shows a tap changer according to the invention with combined, single vacuum switching tube in each load branch.

FIG. 3 shows a first embodiment of a tap changer according to the invention. Here it is schematically illustrated—by a double framing—that the previously separate, parallel arranged vacuum switching cells of one load branch are combined to form a first vacuum switching tube $V_a$ and the previously separate, parallel arranged vacuum switching cells of the other load branch are combined to form a second vacuum switching tube Vb. Combined vacuum switching tubes according to the invention are explained in more detail further below.

It is to be noted here that this combination in accordance with the invention of the functionality of previously separate vacuum switching tubes is not confined to a specific circuit; it is possible whenever two or more vacuum switching tubes are provided in a load branch.

Figure 4:
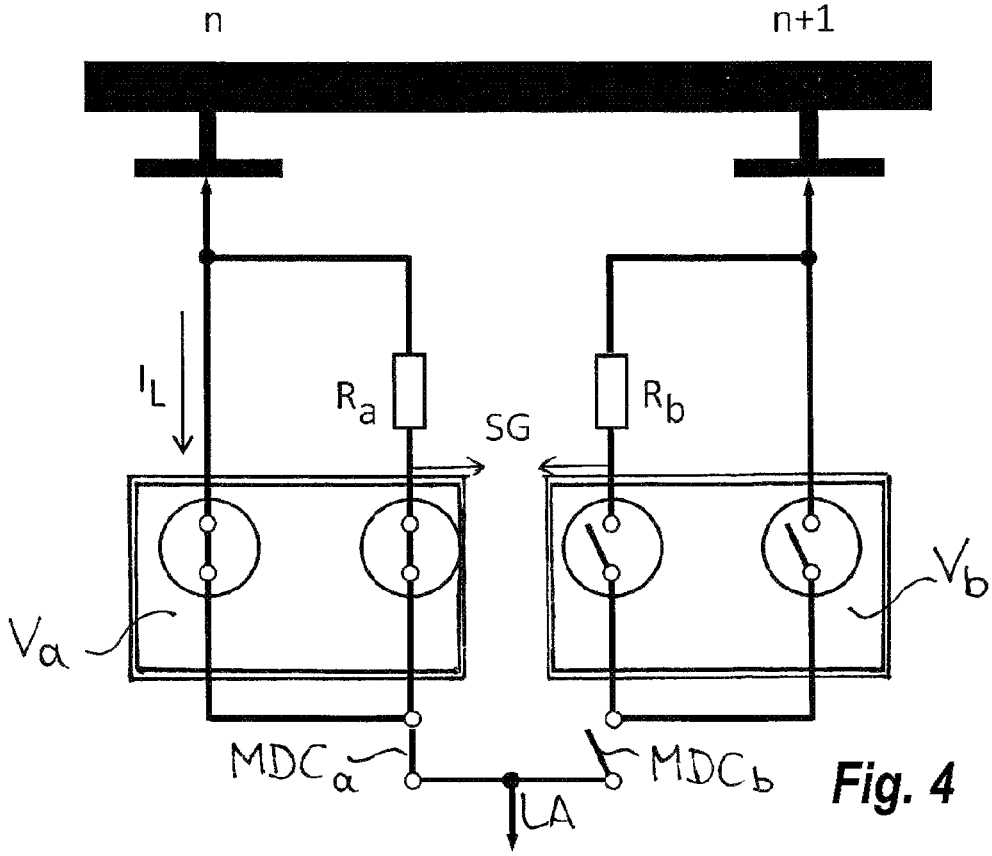
FIG. 4 shows a further tap changer according to the invention with combined, single vacuum switching tube in each load branch that additionally has mechanical contacts.

FIG. 4 therefore shows a second embodiment of a tap changer according to the invention with a developed circuit. In that case, a first mechanical switch $MDC_a$ is additionally provided between the electrical connection of the first vacuum switching tube $V_a$ according to the invention (as substitute for the separate tubes $MSV_a$ and $TTV_a$ according to the prior art) and the load shunt LA. Analogously thereto a further mechanical switch $MDC_b$ is provided between the electrical connection of the second vacuum switching tube $V_a$ according to the invention (as substitute for the separate tubes $TTV_b$ and $MSV_b$ according to the prior art) of the other load branch and the load shunt. The two mechanical switches $MDC_a$, $MDC_b$ are here constructed by way of example as circuit breakers; they serve not for commutation, but for switching free, i.e. electrical separation of the load branch not conducting the load current.

It is also possible within the scope of the invention, for example in the case of a tap changer with four separate vacuum switching cells per phase (such circuits exist in the prior art), to replace each switching cell with a vacuum switching tube combined in accordance with the invention.

Figure 5:
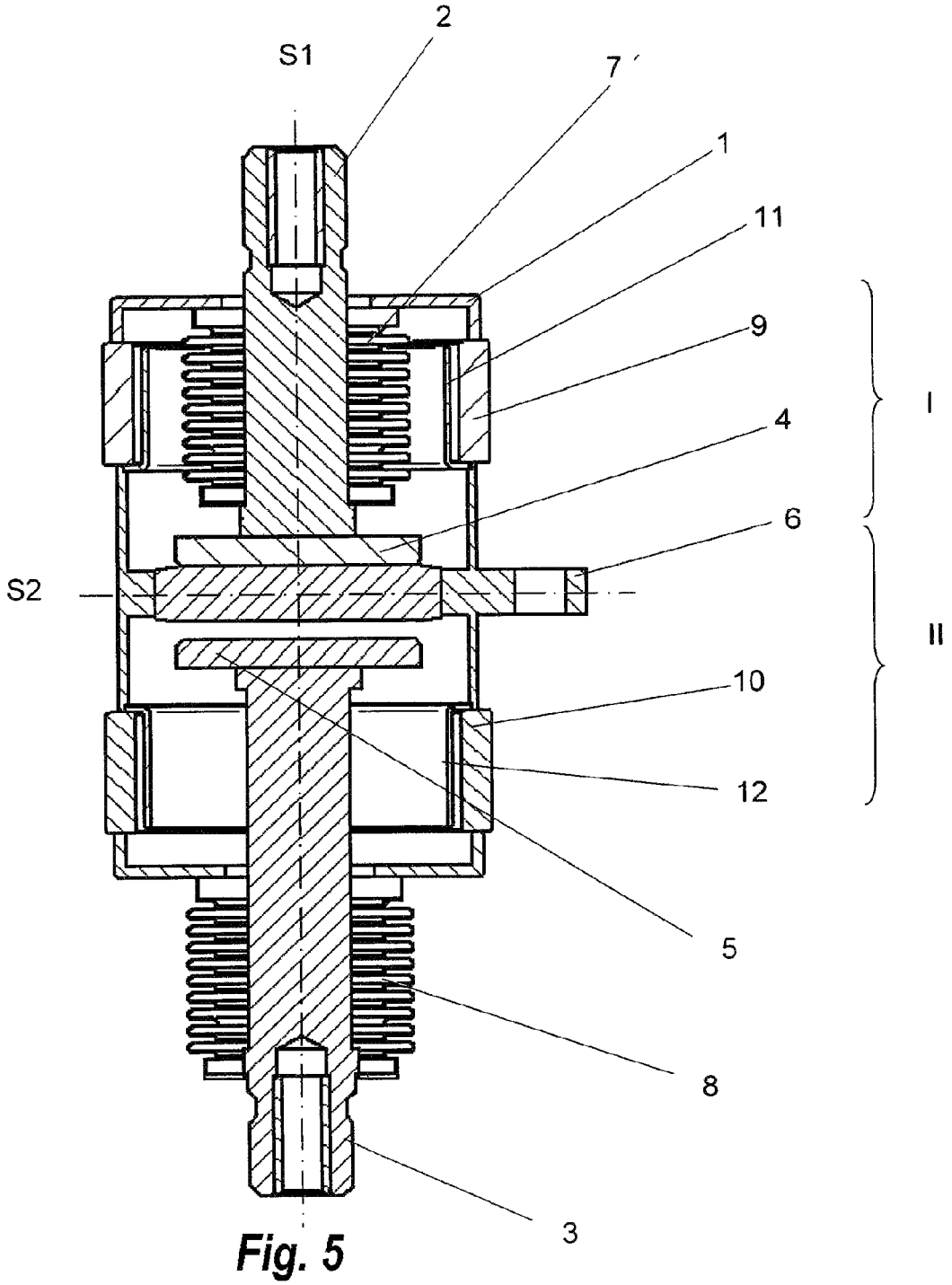
FIG. 5 shows a vacuum switching tube according to the invention.

FIG. 5 shows a vacuum switching tube combined in accordance with the invention. It comprises two separate contact systems 1 and 11 that are arranged on either side of an axis S2 of symmetry in transverse direction of the vacuum switching tube. In that case, a common housing 1 enclosing the entire vacuum switching tube is provided. Provided centrally in the rotationally symmetrical longitudinal axis S1 are an upper plunger 2 and, at the opposite end, a lower plunger 3 that in the interior of the housing 1 carry movable contact members 4, 5 in known manner. The two contact members 4, 5 separately and independently of one another can be brought into connection with a common stationary contact 6 by actuation of the plunger 2 or 3. The known contact springs, which cooperate with the plungers, are, for reasons of clarity, not illustrated here. Illustrated are, however, an upper bellows 7 and a lower bellows 8 that can be constructed identically or also differently. In addition, upper and lower ceramic members 9, 10 as well as, in the interior, upper and lower attenuating screens 11, 12 are illustrated here.

Figure 6:
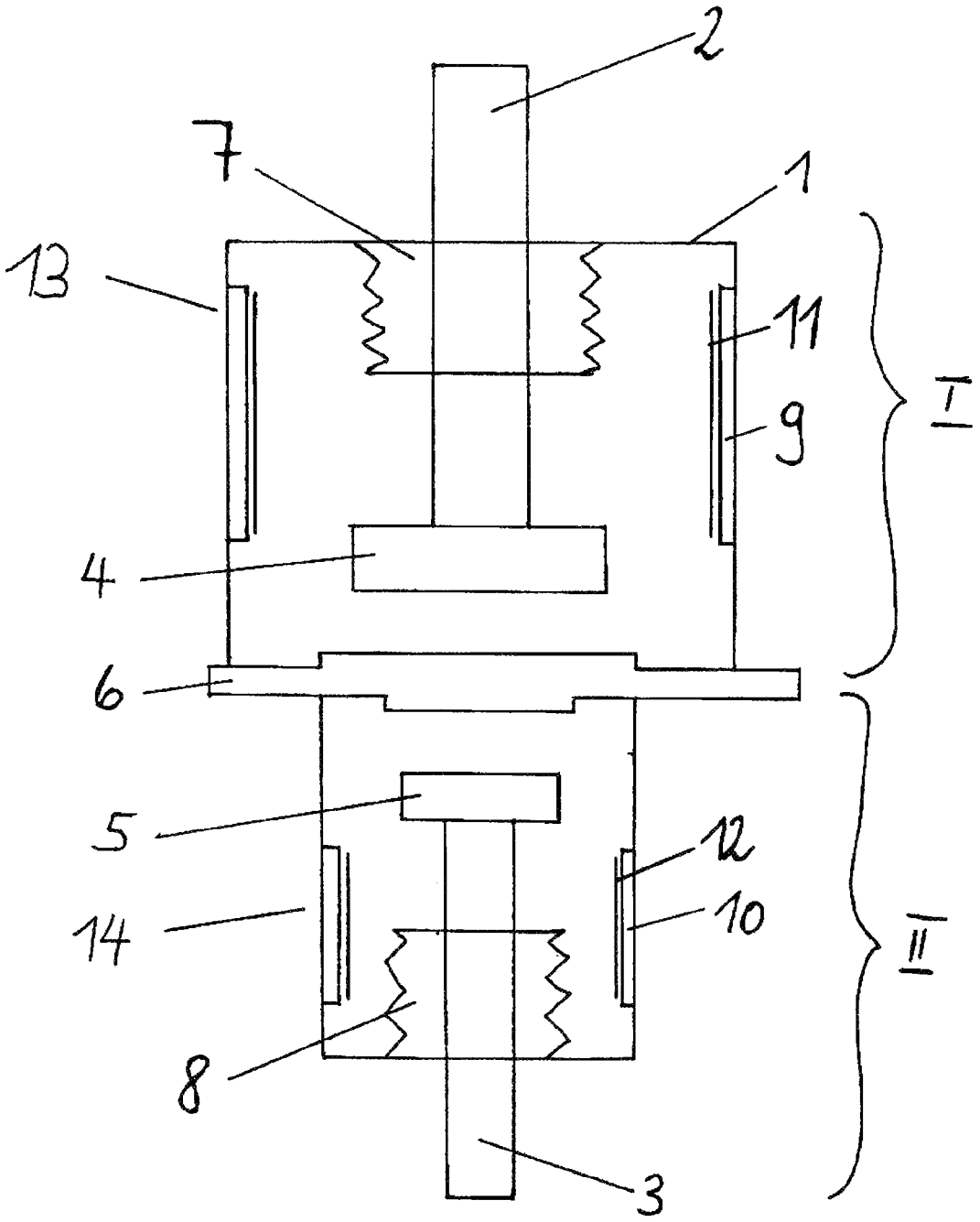
FIG. 6 shows a preferred form of embodiment of a vacuum switching tube according to the invention.

FIG. 6 shows a preferred embodiment of a vacuum switching tube according to the invention in which the contact systems 1 and 11 are adapted to the electrical specifications specific to the tap changer by their different geometric dimensioning. The same reference numerals for identical components are used in FIG. 6 as in FIG. 5. Since the functionalities thereof were already explained in more detail in the description with respect to FIG. 5, no more than the differences of the two forms of embodiment are discussed in the explanations with respect FIG. 6. By contract to FIG. 5, the contact systems 1 and 11 and the components present in the corresponding contact system 1 or 11 are dimensioned to be different in size and in that case the housing 1 is adapted to this geometric dimensioning in that the vacuum switching tube has a first, larger housing part 13 and a second, smaller housing part 14.

Overall, several advantages are achieved with the tap changer according to the invention: The number of vacuum switching tubes necessary is de facto halved; the space necessary for the switching elements is correspondingly smaller. Costs are similarly reduced. This is achieved by the vacuum switching tube used in accordance with the invention, which is constructed as a 'tandem tube' and contains two separate contact systems.

In that case the vacuum switching tube according to the invention is of simple construction; by contrast to the solutions known from the prior art it needs neither internally disposed contact compression springs nor complicated actuation mechanisms or special cage-work contact constructions, for example in annular form.

The invention claimed is:

1. A tap changer for uninterrupted switching between winding taps of a tapped transformer and for connecting the winding taps to a common load, the tap changer comprising for each phase to be switched:

two load branches each connected directly or through a mechanical switch to the common load tap and having a first vacuum switching contact acting as main contact and parallel thereto a switch-over resistance and a respective second vacuum switching contact in series therewith, a single vacuum switching tube holding the first and second two vacuum switching contacts of each load branch, the first and second vacuum switching contacts being movable and actuatable independently of one another in the respective tube and a respective fixed contact in each of the tubes, engageable with the first and second switching contacts of the respective tube, and connected with the common load shunt directly or by a mechanical switch.

2. The tap changer according to claim 1, wherein exactly one series connection of a switch-over resistance and a further vacuum switching contact is provided in each load branch and the one vacuum switching contact and the one further vacuum switching contact of each load branch are combined to form a respective vacuum switching tube.

3. A vacuum switching tube for a tap changer according to claim 1, wherein the first and second switching contacts of each tube are separate and independently actuatable movable in mirror symmetry in the respective tube, the movable contacts are actuatable by respective plungers at opposite sides of a longitudinal axis of the vacuum switching tube, and the two movable contacts are electrically connectable with a single fixed contact.

4. The vacuum switching tube according to claim 3, wherein each of the movable contacts is surrounded by and forms in the respective tube in common with a n respective attenuating screen a respective contact system in a separate respective switching chamber, and the two contact systems and therewith the two respective switching chambers are disposed opposite one another in mirror symmetry about an axis of symmetry perpendicularly to the longitudinal axis of the respective vacuum switching tube.

5. The vacuum switching tube according to claim 3, wherein each of the two plungers is surrounded by a sealing bellows.

6. A tap changer for uninterrupted switching between winding taps of a tapped transformer and for connecting the winding taps to a common load, the tap changer comprising for each phase to be switched:

two load branches each connected directly or through a mechanical switch to the common load and having a first vacuum switching contact acting as main contact and parallel thereto a switch-over resistance and a respective second vacuum switching contact in series therewith, a single vacuum switching tube holding the first and second vacuum switching contacts of each load branch, the first and second vacuum switching contacts being movable and actuatable independently of one another in the respective tube and a respective fixed contact in each of the tubes, engageable with the movable switching contacts of the respective tube, and connected with the common load shunt directly or by a mechanical switch, the two contact systems being dimensioned to be of geometrically different size in such a manner that they are respectively adapted to the electrical boundary conditions of the tap changer in which the vacuum switching tube is installed.

* * * * *